US009374647B2

(12) United States Patent
Han et al.

(10) Patent No.: US 9,374,647 B2
(45) Date of Patent: Jun. 21, 2016

(54) METHOD AND APPARATUS USING HEAD MOVEMENT FOR USER INTERFACE

(71) Applicant: Samsung Electronics Co., Ltd., Suwon-si (KR)

(72) Inventors: Jooman Han, Seoul (KR); Dong Wook Kim, Seoul (KR); Jong Hee Han, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 34 days.

(21) Appl. No.: 14/320,008

(22) Filed: Jun. 30, 2014

(65) Prior Publication Data

US 2015/0003651 A1 Jan. 1, 2015

(30) Foreign Application Priority Data

Jul. 1, 2013 (KR) ..... 10-2013-0076509

(51) Int. Cl.

*H04R 25/00* (2006.01)
*H04R 1/10* (2006.01)
*H04R 5/033* (2006.01)

(52) U.S. Cl.

CPC ..... *H04R 25/50* (2013.01); *H04R 1/1041* (2013.01); *H04R 5/033* (2013.01); *H04R 25/30* (2013.01); *H04R 25/552* (2013.01); *H04R 2225/41* (2013.01); *H04R 2225/61* (2013.01); *H04R 2430/01* (2013.01)

(58) Field of Classification Search

CPC .... H04R 25/30; H04R 25/305; H04R 25/405; H04R 25/55; H04R 2225/61; H04R 2460/07; H04R 2225/41

See application file for complete search history.

(56) References Cited

U.S. PATENT DOCUMENTS

| | | | | |
|---|---|---|---|---|
| 7,590,772 | B2 * | 9/2009 | Marriott | H04M 1/72522 710/15 |
| 7,778,433 | B2 * | 8/2010 | Lee | H04R 25/453 381/312 |
| 8,121,319 | B2 * | 2/2012 | Azizi | G01S 5/186 381/306 |
| 8,781,142 | B2 * | 7/2014 | Olafsson | H04R 25/407 381/312 |
| 8,873,781 | B2 * | 10/2014 | Hannemann | H04R 5/033 381/320 |
| 2005/0078833 | A1 | 4/2005 | Hess et al. | |
| 2005/0276419 | A1 | 12/2005 | Eggert et al. | |
| 2008/0192968 | A1 * | 8/2008 | Ho | H04R 25/405 381/313 |
| 2008/0260189 | A1 * | 10/2008 | Schobben | H04R 25/405 381/313 |
| 2011/0200213 | A1 * | 8/2011 | Knox | H04R 25/505 381/314 |
| 2012/0114132 | A1 * | 5/2012 | Abrahamsson | H04R 1/1016 381/74 |
| 2014/0016788 | A1 * | 1/2014 | Rass | H04R 25/70 381/23.1 |
| 2014/0036127 | A1 * | 2/2014 | Pong | H04R 1/028 348/333.01 |

* cited by examiner

*Primary Examiner* — Curtis Kuntz
*Assistant Examiner* — Ryan Robinson
(74) *Attorney, Agent, or Firm* — NSIP Law

(57) ABSTRACT

A hearing device, a hearing device controller and a method of controlling a hearing device are provided. A hearing device includes a movement estimation unit configured to estimate a head movement using audio signals, and a hearing device control unit configured to control an operation of the hearing device based on the estimated head movement.

20 Claims, 8 Drawing Sheets

METHOD AND APPARATUS USING HEAD MOVEMENT FOR USER INTERFACE

CROSS-REFERENCE TO RELATED APPLICATION(S)

This application claims the benefit under 35 USC 119(a) of Korean Patent Application No. 10-2013-0076509 filed on Jul. 1, 2013, in the Korean Intellectual Property Office, the entire disclosure of which is incorporated herein by reference for all purposes.

BACKGROUND

1. Field

The following description relates to an apparatus and a method that use a head movement for a user interface (UI), and to an apparatus operated by a head movement and a method of operating the same.

2. Description of Related Art

Hearing devices provide audio signals to users. Examples of hearing devices include a hearing aid, and examples of audio devices include an earphone and a headphone.

Hearing aids are used to help a user perceive a sound that is generated outside by amplifying the sound for the user. Conventionally available hearing aids may be classified into pocket type hearing aids, caning type hearing aids, concha type hearing aids, eardrum type hearing aids, and the like.

An audio device refers to a device that is used for listening to a voice or sound, such as a radio and a stereo. The audio device may include a device that is fixed to or tightly attached to an ear of the user, such as an earphone and a headphone.

With the development of technology, various functions are being provided by hearing devices in addition to their traditional functions. Therefore, users of the hearing devices are increasing. As a result, there is a demand for a more convenient method of controlling hearing devices, for not only for hearing loss patients, but also for users in a situation in which it is hard to operate the hearing device, such as during driving an automobile.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, there is provided a hearing device including a movement estimation unit configured to estimate a head movement using audio signals, and a hearing device control unit configured to control an operation of the hearing device based on the estimated head movement.

The general aspect of the hearing device may further include an audio signal detection unit including at least two microphones and configured to detect the audio signals through the at least two microphones.

The movement estimation unit may be configured to estimate the head movement based on time difference information or level difference information related to the detected audio signals.

The movement estimation unit may be configured to acquire at least one of the time difference information and the level difference information based on relative positions of the microphones.

The time difference information may include interaural time difference (ITD) information of the detected audio signals, and the level difference information may include interaural level difference (ILD) information of the detected audio signals.

The general aspect of the hearing device may further include a lookup table relating at least one of predetermined time difference information and predetermined level difference information with a corresponding head movement. The movement estimation unit may be configured to estimate the head movement corresponding to the at least one of the time difference information and the level difference information of the detected audio signals by referencing the lookup table.

The general aspect of the hearing device may further include a gesture detection unit configured to detect a user gesture. The hearing device control unit may be configured to to control the operation of the hearing device based on a predetermined user gesture in response to the predetermined user gesture being detected by the gesture detection unit.

The general aspect of the hearing device may further include a gesture mapping unit configured to store mapping information on the operation of the hearing device to the predetermined user gesture. The hearing device control unit may be configured to control the operation of the hearing device based on the detected user gesture by referencing the gesture mapping unit.

The hearing device control unit may be configured to control the operation of the hearing device based on a predetermined head movement in response to the predetermined head movement being detected.

The general aspect of the hearing device may further include a head movement mapping unit configured to store mapping information on the operation of the hearing device to the predetermined head movement, and the hearing device control unit may be configured to control the operation of the hearing device based on the estimated head movement by referencing the head movement mapping unit.

The general aspect of the hearing device may further include an operation information providing unit configured to provide information on the operation of the hearing device to the user. The operation information providing unit may be configured to provide feedback information comprising at least one of a visual feedback, an audio feedback, and a tactile feedback related to the operation of the hearing device.

The operation information providing unit may be configured to provide information on an operation other than a current operation of the hearing device.

The general aspect of the hearing device may further include an external device control unit configured to control an operation of an external device based on the estimated head movement.

In another general aspect, there is provided a hearing device controller including a movement estimation unit configured to estimate a head movement using audio signals received from a hearing device, and a hearing device control unit configured to control an operation of the hearing device based on the estimated head movement.

The general aspect of the hearing device controller may further include a communication unit configured to receive information on the audio signals from the hearing device.

The general aspect of the hearing device controller may further include an external device control unit configured to control an operation of an external device based on the estimated head movement.

The general aspect of the hearing device controller may further include an operation information providing unit configured to provide information on the operation of the hearing device to the user. The operation information providing unit may be configured to provide feedback information comprising at least one of a visual feedback, an audio feedback, and a tactile feedback related to the operation of the hearing device to the user.

In another general aspect, there is provided a hearing device including an audio signal detection unit comprising at least two microphones and configured to detect audio signals through the at least two microphones, and a communication unit configured to transmit information on the audio signals to a hearing device controller.

In yet another general aspect, there is provided a method of operating a hearing device, the method involving detecting audio signals through at least two microphones of the hearing device, analyzing the audio signals to detect a head movement of a user, and controlling an operation of the hearing device based on the detected head movement.

The analyzing of the audio signals may involve estimating the head movement of the user based on time difference information or level difference information based on relative positions of the at least two microphones.

Other features and aspects will be apparent from the following detailed description, the drawings, and the claims.

Figure 1:
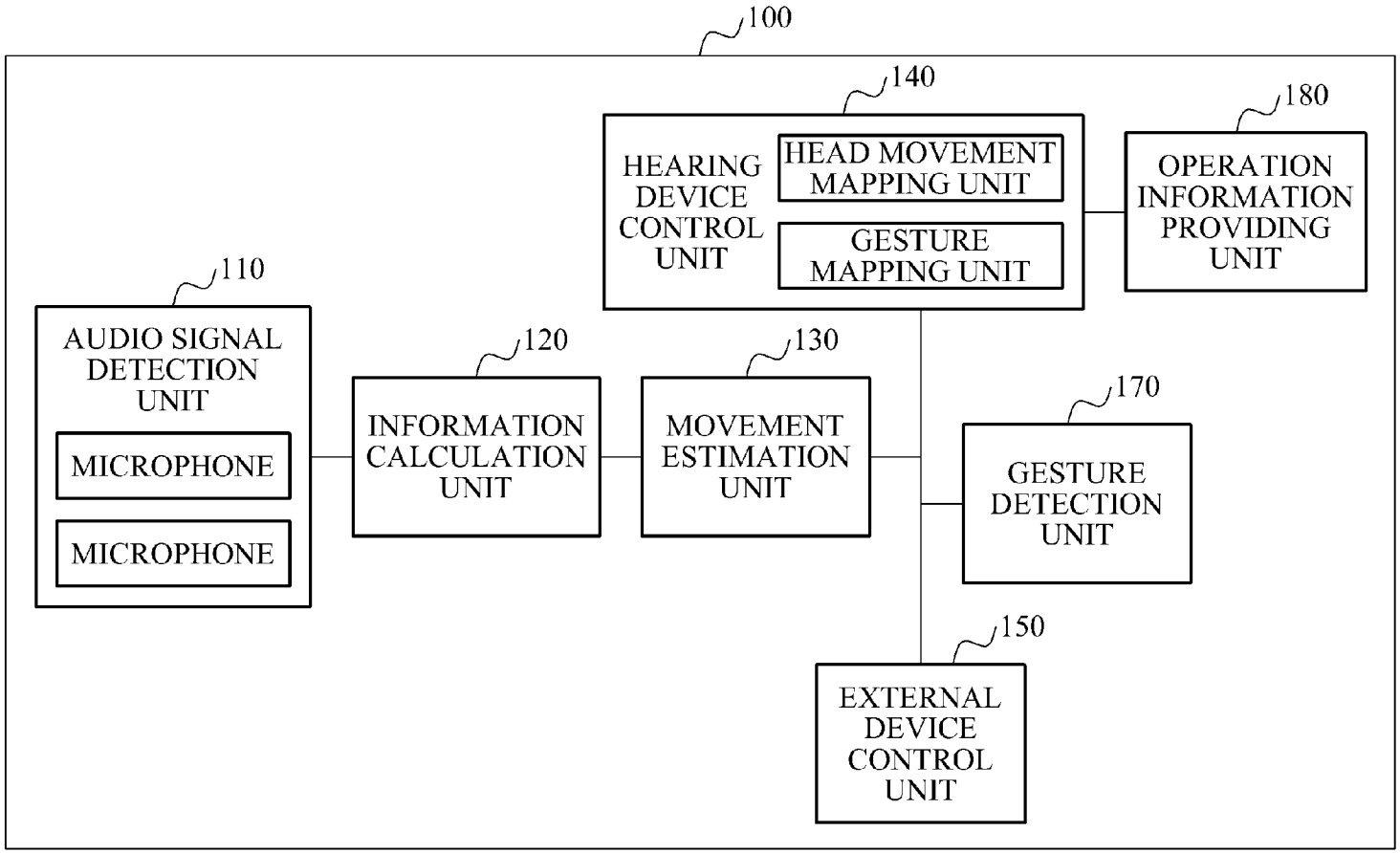
FIG. 1 is a block diagram illustrating an example of a hearing device.

Throughout the drawings and the detailed description, unless otherwise described or provided, the same drawing reference numerals will be understood to refer to the same elements, features, and structures. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the systems, apparatuses and/or methods described herein will be apparent to one of ordinary skill in the art. The progression of processing steps and/or operations described is an example; however, the sequence of and/or operations is not limited to that set forth herein and may be changed as is known in the art, with the exception of steps and/or operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

A hearing device refers to a device that provides audio signals to a user. A hearing device may be detachably fixed to or may tightly contact an ear of the user during sound transmission to the user. An example of a hearing device includes a hearing aid that helps a user perceive audio signals generated outside by amplifying the audio signals and transmitting the amplified audio signals to the user. The hearing device may also include an audio device that is fixed to or tightly contacts the ear of the user during its operation, such as a receiver, an earphone, and a headphone. Examples of a hearing device include a monaural device that generates audio signals for one ear, and a binaural device that generates audio signals for both ears.

A hearing device according to an example embodiment may operate in a general mode or a movement control mode. The general mode refers to an operation mode for performing general functions, for example, a general function of a hearing aid and a general function of an audio device. This includes changing settings or initiating functions using buttons that are provided on the hearing device, for example. The movement control mode refers to an operation mode for controlling operations of the hearing device based on a head movement of the user. The head movement of the user may be detected by estimating the movement, using various sensors and detection units. Hereinafter, the hearing device performing the movement control mode will be described.

FIG. 1 illustrates an example of a hearing device 100.

Referring to FIG. 1, the hearing device 100 includes an audio signal detection unit 110, an information calculation unit 120, a movement estimation unit 130, a hearing device control unit 140, and an external device control unit 150. The hearing device 100 may further include a hearing device controller that will be described later with reference to FIG. 2.

In this example, the audio signal detection unit 110 includes at least two microphones, and detects audio signals received from each of the at least two microphones. In a hearing device that is a binaural device, a left audio signal detection unit and a right audio signal detection unit of the binaural device may each include at least one microphone. In a hearing device that is a monaural device, the audio signal detection unit may include at least two microphones. In this case, the at least two microphones may be disposed in different positions. Accuracy in estimation of the head movement may be increased according to an increased number of the microphones included in the audio signal detection unit 110. Accordingly, in other examples, the hearing device may include three or more microphones.

In a hearing device that is an audio device such as an earphone or a headphone, in which the audio device provides an active noise canceller function, the audio signal detection unit 110 may detect the audio signals using at least two microphones provided for the active noise canceller function.

The audio signal detection unit 110 may detect the audio signals from the outside. Here, the outside refers to an environment other than the hearing device 100. When the hearing device 100 and the hearing device controller are separated, the audio signal detection unit 110 may detect the audio signals generated by the hearing device controller. In addition, the audio signal detection unit 110 may detect the audio signals unrelated to the hearing device 100 and the hearing device controller.

The information calculation unit 120 may calculate information on the audio signals detected by the audio signal detection unit 110. The information on the detected audio signals may include at least one of time difference information and level difference information of the detected audio signals. The time difference information of the detected audio signals may include information on a phase difference of the audio signals. The information calculation unit 120 may be included in the audio signal detection unit 110 or separated from the audio signal detection unit 110.

In a hearing device that is a monaural device, the information calculation unit 120 may calculate the information on the audio signals using the relative positions of the at least two microphones included in the audio signal detection unit 110. Since the at least two microphones are disposed in different positions, the audio signals received from the at least two microphones may have different characteristics. For example, even when audio signals generated from one source are detected, times, phases, or levels of the audio signals detected by the at least two microphones may differ according to the head movement of the user. The information calculation unit 120 may calculate the information on the audio signals by calculating a time difference, a phase difference, or a level difference of the audio signals detected by the microphones.

In a hearing device that is a binaural device, the information calculation unit 120 may calculate the information on the audio signals using a difference between characteristics of audio signals detected by at least one microphone included in a left hearing device and characteristics of audio signals detected by at least one microphone included in a right hearing device. For example, the time difference information of the detected audio signals may refer to an interaural time difference (ITD) information of the detected audio signals, and the level difference information may refer to interaural level difference (ILD) information of the detected audio signals. For example, when the audio signals are generated from one source disposed in front of the user, the user may turn his or her head from the front to the left. In response, a detection time of the left hearing device with respect to the audio signals may be elongated whereas a detection time of the right hearing device may be shortened. In addition, while the level of the audio signals detected by the left hearing device may be reduced, the level of the audio signals detected by the right hearing device may be increased.

The movement estimation unit 130 may estimate the head movement using information obtained from the audio signals based on calculations performed by the information calculation unit 120. The movement estimation unit 130 may include a lookup table to record at least one of predetermined time difference information and predetermined level difference information, and a corresponding head movement. In addition, the movement estimation unit 130 may estimate the head movement using factors other than the predetermined time difference information, the level difference information, and the lookup table.

The time difference information or the level difference information of the audio signals may differ for each types of head movements. The time difference information or the level difference information of the audio signals according to various predetermined head movements may be calculated in advance and stored in the lookup table. The time difference information or the level difference information stored in the lookup table may be a predetermined range of values.

The movement estimation unit 130 may estimate the head movement corresponding to at least one of the time difference information and the level difference information, by referencing the lookup table.

In one example embodiment, the movement estimation unit 130 may identify similarity between at least one of the time difference information and the level difference information of the detected hearing devices and reference values corresponding to the predetermined head movements. The reference values corresponding to the predetermined head movements may be at least one of the predetermined time difference information and the predetermined level difference information stored in the lookup table. When the hearing device is a binaural device, the movement estimation unit 130 may identify the similarity between at least one of the ITD information and the ILD information of the detected audio signals and the reference values corresponding to the predetermined head movements. The movement estimation unit 130 may estimate the head movement based on the similarity. For example, the movement estimation unit 130 may identify a reference value making highest similarity with respect to the detected audio signals, among the reference values corresponding to the various predetermined head movements, and estimate a head movement corresponding to the identified reference value as the head movement of the user.

The hearing device control unit 140 may control operation of the hearing device 100 based on the estimated head movement. When a predetermined head movement is detected, the hearing device control unit 140 may control the operation of the hearing device 100 based on the detected predetermined head movement. The hearing device control unit 140 may include a head movement mapping unit configured to store information on the operation of the hearing device 100, in which the operation is mapped with a predetermined head movement. A plurality of predetermined head movements may be mapped to a plurality of possible operations of the hearing device 100. For example, a movement of lifting the head may be mapped with an operation of increasing the volume of the hearing device 100 while a movement of lowering the head may be mapped with an operation of decreasing the volume of the hearing device 100. The foregoing mapping information may be stored in the head movement mapping unit.

The hearing device control unit 140 may control the operation of the hearing device 100 corresponding to the estimated head movement, by referencing the head movement mapping unit.

The operations of the hearing device 100 controlled by the hearing device control unit 140 may include at least one of operation mode setting, function setting, and parameter setting. The operation mode setting may involve setting of a music mode, a driver conversation mode, a speech mode, a speech in noise mode, a quiet mode, a wind mode, a lower power mode, and the like. The function setting may involve setting of a phone conversation function, a stereo function, a noise reduction function, a reverberation removal function, a binaural function, an external device connection function, and the like. The parameter setting may involve setting of parameters such as a volume, an equalizer, power consumption, volume of a particular frequency band, and the like. The operation mode setting, the function setting, and the parameter setting may be triggered with corresponding predetermined head movements. For example, the operation of increasing the volume of the hearing device 100 may correspond to the movement of lifting the head. In this example, in response to the movement of lifting the head being estimated by the movement estimation unit 130, the hearing device control unit 140 may increase the volume of the hearing device 100.

Referring to FIG. 1, the hearing device 100 also includes a gesture detection unit 170 configured to detect a user gesture. In this example, the user gesture refers to a gesture made by the user, other than a head movement. For example, the user gesture may include a touch gesture of touching the hearing device 100 or a hand gesture making a particular motion by a hand around the hearing device 100. In one example, the gesture detection unit 170 may include a touch sensor, and may be configured to detect the touch gesture of the user by the touch sensor. However, in another example, the gesture detection unit 170 may not be present.

According to another example, the gesture detection unit 170 may include a telecoil. The telecoil may detect a magnetic field around the hearing device 100. The gesture detection unit 170 may detect the hand gesture of the user by detecting a change in the magnetic field. For example, when the user waves his or her hand wearing a magnetic ring, the magnetic field around the hearing device 100 may change and the hand gesture of the user may be detected through the change in the magnetic field.

When a predetermined user gesture is detected, the hearing device control unit 140 may control the operation of the hearing device 100 corresponding to the predetermined user gesture. In this example, the hearing device control unit 140 includes a gesture mapping unit configured to store information on operation of the hearing device 100, the operation being mapped with a predetermined user gesture. The hearing device control unit 140 may control the operation of the hearing device 100 corresponding to the detected user gesture, by referencing the gesture mapping unit. For example, information that a specific touch gesture was made once during a predetermined time period may correspond to an on operation of the at least two microphones, and information that the same touch gesture was made twice during the predetermined time period may correspond to an off operation of the at least two microphones. The correlation between the information regarding the touch gesture and the operation to be performed may be stored in the gesture mapping unit. In this example, in response to one of the touch gestures stored in the gesture mapping unit being detected during the predetermined time period, the hearing device control unit 140 may turn on the at least two microphones by referencing the gesture mapping unit.

The hearing device 100 may further include an operational information providing unit 180 configured to provide information on the operation of the hearing device to the user, as illustrated in FIG. 1. The operation information providing unit 180 may provide feedback information related to the controlled operation, or may provide the status information regarding the hearing device 100 or regarding an operation other than a current operation of the hearing device 100 that is being performed.

The operation information providing unit 180 may provide the feedback information by providing any one of a visual feedback, an audio feedback, and a tactile feedback related to the operation of the hearing device 100.

For example, when the hearing device control unit 140 turns down the volume based on the estimated movement, the operation information providing unit 180 may provide the user with an audio feedback such as "The volume will be turned down." Here, when the hearing device 100 is connected with an external device, the operation information providing unit 180 may provide a visual feedback such as an 'icon indicating a decrease of the volume' using the external device. In addition, in response to the hearing device control unit 140 increasing and then decreasing the volume based on the estimated movement, the operation information providing unit 180 may provide a tactile feedback by generating relatively strong oscillation when the volume is increased and relatively weak vibration when the volume is decreased.

The operation information providing unit 180 may provide the status information of the hearing device 100. For example, when a residual battery power of the hearing device 100 is about 5% of the entire battery power, the operation information providing unit 180 may provide the user with a voice message such as "5% battery power is left. Please charge the battery."

The operation information providing unit 180 may provide the information on an operation other than a current operation of the hearing device 100. For example, the hearing device 100 may include a proper operation identifying unit (not shown) configured to identify another operation as more appropriate than the current operation of the hearing device 100. The proper operation identifying unit (not shown) may include an external environment detection unit (not shown) configured to detect an external environment. The external environment may include an oscillation frequency, a frequency, a radio wave, and the like generated from an external source. Also, the external environment may include light. In an example in which light is detected to determine the proper operation, the hearing device 100 may include an optical sensor, and may detect the external environment according to a change of light, such as night and day, using the optical sensor. In addition, the hearing device 100 may include a temperature sensor, an acceleration sensor, an angular velocity sensor, and the like that are used for detecting the external environment. By detecting the change in the external environment, the proper operation identifying unit (not shown) may identify the another operation to be performed that is more appropriate than the current operation of the hearing device 100. The proper operation identifying unit (not shown) may be included in the operation information providing unit.

When an operation that is more appropriate than the current operation is identified, the information providing unit 180 may provide information regarding the appropriate operation to the user. For example, the user of the hearing device 100 may set the operation mode of the hearing device 100 to the 'speech mode' when the talking to other people. In this example, in the event that the user passes by a construction site that is noisy, the external environment detection unit (not shown) may detect the environmental noise and the proper operation identifying unit (not shown) may identify the 'speech in noise mode' as a more proper mode than the current mode, which is the 'speech mode.' The operation information providing unit (not shown) may provide a voice message "Would you like to change to the speech in noise mode?" to the user. When a head movement corresponding to 'YES' is detected by the movement estimation unit 130, the hearing device control unit 140 may change the operation mode of the hearing device 100 to the 'speech in noise mode' according to the head movement.

The external device control unit 150 may control operation of the external device based on the estimated head movement. The external device may refer to a device other than the hearing device 100. For example, the external device may include all types of data processing apparatus, for example, a personal computer (PC), a notebook, a television (TV), an audio, and a mobile terminal such as a mobile phone, a tablet PC, and a personal digital assistant (PDA).

The hearing device 100 may be connected with the external device. The connection of the hearing device 100 with the external device may be achieved through the hearing device control unit 140 or by the external device control unit 150, or by another method unrelated to the hearing device 100. For example, the external device may be a mobile terminal, and the hearing device 100 and the mobile terminal may be interconnected through inter-device wireless communication. In another example, the hearing device 100 may be connected to the external device through a physical connection. In another example, the hearing device 100 and the external device may be connected through a Bluetooth connection.

The external device control unit 150 may identify a predetermined head movement mapped with the estimated head movement, and control the operation of the external device according to the identified head movement. For example, the external device control unit 150 may generate a control signal with respect to the operation of the external device, and may transmit the control signal to the external device through the communication unit (not shown). For example, when the hearing device 100 and the mobile terminal are interconnected, volume control of the mobile terminal, execution of an application, or control of another operation of the mobile terminal may be performed according to the estimated head movement.

Figure 2:
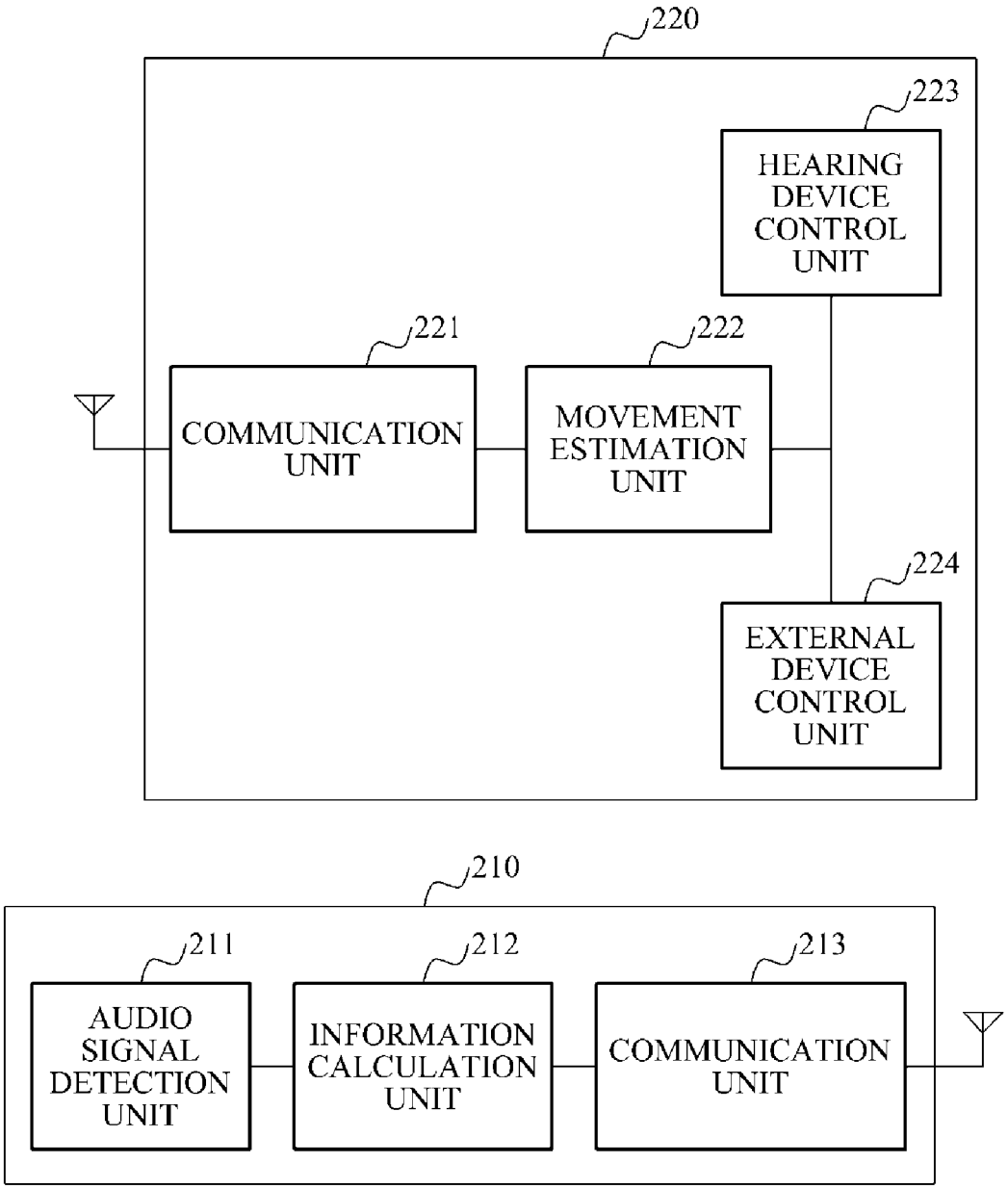
FIG. 2 is a block diagram illustrating an example of a hearing device controller and an example of a hearing device that pairs with the hearing device controller.

FIG. 2 illustrates an example of a hearing device controller 220 and an example of a hearing device 210 that pairs with the hearing device controller 220.

Referring to FIG. 2, the hearing device 210 includes an audio signal detection unit 211, an information calculation unit 212, and a communication unit 213. The audio signal detection unit 211 may include at least two microphones and may detect audio signals received from each of the at least two microphones. The information calculation unit 212 may calculate information on the audio signals detected by the audio signal detection unit 211. The information regarding the detected audio signals may include time difference information or level difference information related to the detected audio signals. In a binaural device, the time difference information may refer to ITD information of the detected audio signals while the level difference information may refer to ILD information of the detected audio signals. The description regarding the audio signal detection unit 110 and the information calculation unit 120 of FIG. 1 may be directly applied to the audio signal detection unit 211 and the information calculation unit 212.

The communication unit 213 may transmit the information regarding the audio signals, as calculated by the information calculation unit 212, to the hearing device controller 220. The communication unit 213 may also receive a control signal related to the operation of the hearing device 210. The operation of the hearing device 210 may be controlled according to the control signal.

The hearing device controller 220 includes a communication unit 221, a movement estimation unit 222, a hearing device control unit 223, and an external device control unit 224. The hearing device controller 220 may be independently provided or may be included in the hearing device 210 or in the external device. For example, the hearing device controller 220 may be included in the mobile terminal.

The communication unit 221 may receive the information on the audio signals calculated by the hearing device 210 from the hearing device 210. In addition, the communication unit 213 may transmit the control signal related to the operation of the hearing device 210 to the hearing device 210. The control signal may be generated by the hearing device control unit 223. Also, the communication unit 213 may transmit a control signal related to operation of the external device to the external device. The control signal may be generated by the external device control unit 224.

The movement estimation unit 222 may estimate a head movement using the information obtained from the audio signals. The hearing device control unit 223 may control the operation of the hearing device 210 based on the estimated head movement. The hearing device control unit 223 may generate the control signal related to the operation of the hearing device 210 and may transmit the control signal through the communication unit 221.

The external device control unit 224 may control the operation of the external device based on the estimated head movement. The external device control unit 224 may also generate the control signal related to the external device and may transmit the control signal through the communication unit 221.

The hearing device controller 220 may include an operation information providing unit (not shown) and a proper operation identifying unit (not shown). For example, when a music mode is determined to be more proper than a speech mode that is a current operation mode of the hearing device 210 by the proper operation identifying unit (not shown), the operation information providing unit (not shown) may provide a voice message of "Would you like to change to the music mode?" The audio signal detection unit 211 of the hearing device 210 may detect the voice message provided by the hearing device controller 220 and calculate at least one of time difference information and level difference information of the detected voice message through the information calculation unit 212. The communication unit 221 of the hearing device controller 220 may receive information on the voice message and the movement estimation unit 222 may estimate the head movement using the information on the voice message. When the movement estimation unit 222 estimates the head movement corresponding to 'NO', the hearing device control unit 223 may maintain the speech mode, which is the current operation mode of the hearing device 210, according to the estimated head movement. The description of the operation information providing unit 180 and the proper operation identifying unit (not shown) provided with reference to FIG. 1 is also applicable to the operation information providing unit (not shown) and the proper operation identifying unit of the hearing device controller 220.

The description about the movement estimation unit 130, the hearing device control unit 140, and the external device control unit 150 of FIG. 1 may be directly applied to the movement estimation unit 222, the hearing device control unit 223, and the external device control unit 224.

Figure 3:
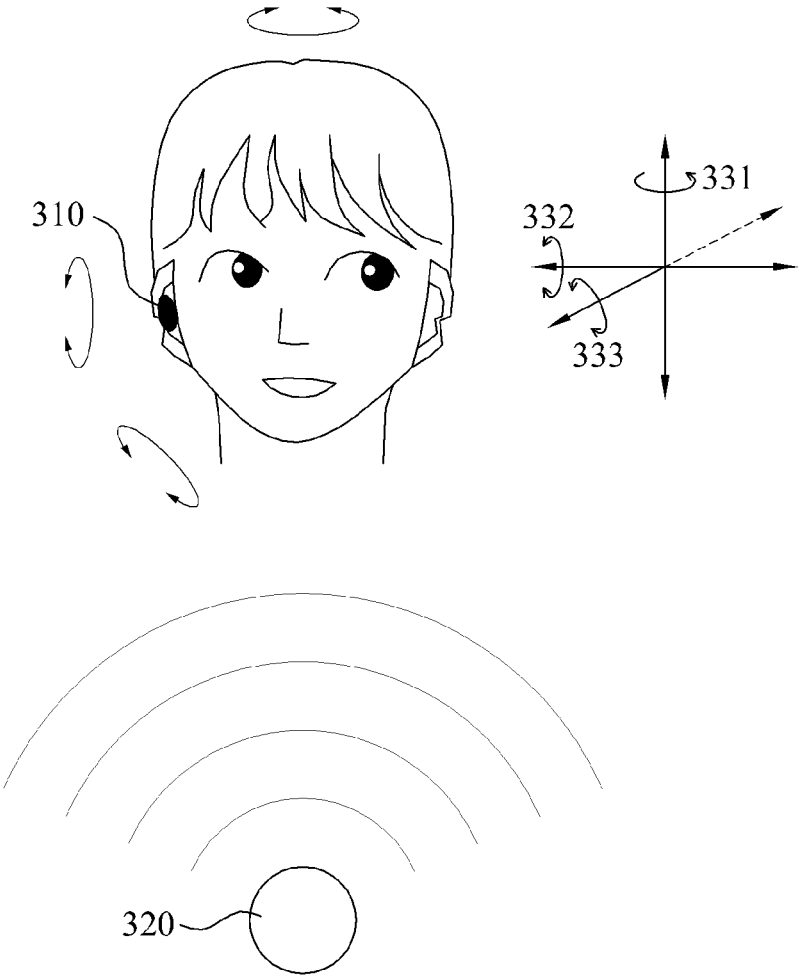
FIG. 3 is a diagram illustrating an example of a method of estimating a head movement.

FIG. 3 is a diagram illustrating an example of a method of estimating a head movement.

Referring to FIG. 3, a user is wearing a hearing device 310. Although FIG. 3 illustrates a monaural device as the hearing device 310, in other examples, the hearing device may be a binaural device. The hearing device 310 may detect audio signals from the outside. In the example illustrated in FIG. 3, the hearing device 310 may detect the audio signals generated from a source 320. In this case, the source 320 may be plural in number and the plurality of sources may be disposed in different positions. Also, the source 320 may be a hearing device controller.

The hearing device 310 may detect audio signals from the outside using at least two microphones, and may calculate information regarding the detected audio signals. In this example, the hearing device 310 is a monaural device. When the hearing device 310 is a monaural device, the hearing device 310 may calculate at least one of time difference information and level difference information related to the audio signals. In an example in which the hearing device 310 is a binaural device, the hearing device 310 may calculate at least one of ITD information and ILD information.

The hearing device 310 may estimate a head movement or a direction of movement of the hearing device 310, corresponding to at least one of the time difference information and the level difference information, by referencing at least one of predetermined time difference information and predetermined level difference information and a lookup table recording corresponding head movements.

In one example, a predetermined head movement may be indicated by a roll rotation angle or an x-axis rotation, a pitch rotation angle or a y-axis rotation, and a yaw rotation angle or a z-axis rotation. Therefore, the predetermined head movement may be divided into components. For example, the yaw rotation angle may be changed when the user shakes his or her head to the right and the left 331, and the pitch rotation angle may be changed when the user nods his or her head up and down 332. When the user tilts his or her head to the right or the left 333, the roll rotation angle may be changed. Reference values corresponding to the detailed head movements may be stored in the lookup table. Accordingly, the hearing device 310 may identify a reference value that is most similar to at least one of the time difference information and the level difference information of the detected audio signals, among the reference values corresponding to the predetermined head movements divided into components, and estimate a head movement corresponding to the identified reference value as the head movement of the user.

With the use of at least two microphones and the information calculation unit, according to one example, it is possible to estimate the head movements without using an acceleration sensor or other movement sensors. However, in other examples, the detection of the head movement is not limited thereto.

Figure 4A:
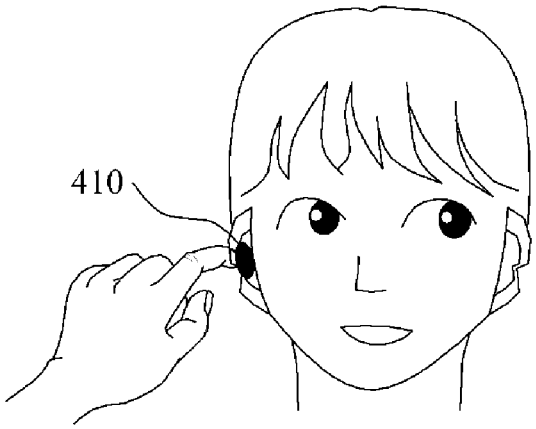
FIGS. 4A to 4C are diagrams illustrating examples of methods of initiating an operation of a hearing device.
Figure 4B:
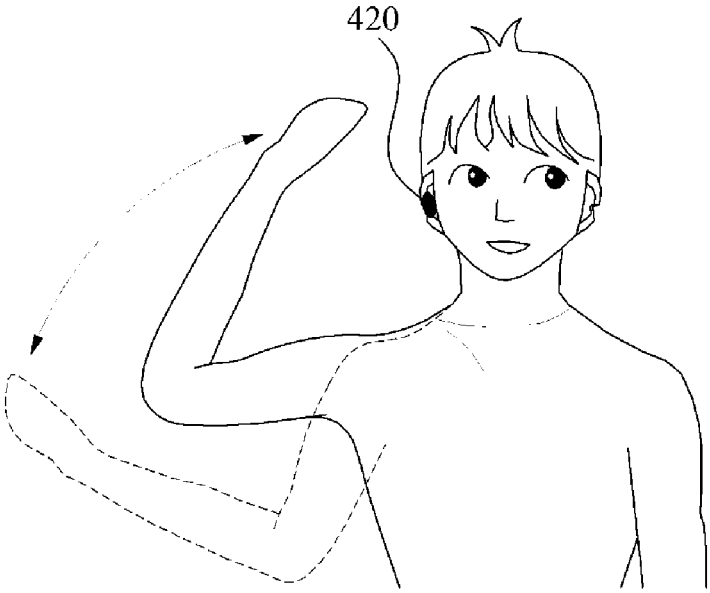
Figure 4C:
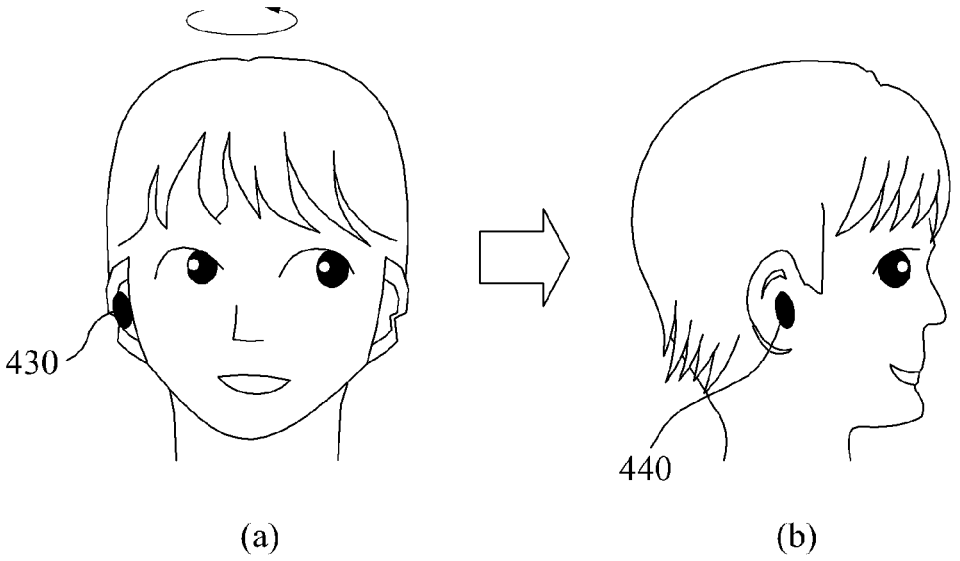

FIGS. 4A to 4C illustrate an example of a start operation of a hearing device. The start operation refers to an operation for entering a movement control mode using a user interface (UI). The UI may include a user gesture and a head movement.

Referring to FIG. 4A, an example of a hearing device 410 includes a touch sensor and is configured to detect a touch gesture using the touch sensor. The hearing device 410 may allow switching between a touch gesture mode and a general mode. In this example, the touch gesture made once during a predetermined time may correspond to an on operation of entering the movement control mode and the touch gestures made twice during the predetermined time may correspond to an operation of entering a general mode. The foregoing information may be stored in a gesture mapping unit (not shown). The description of the gesture mapping unit provided with respect to FIG. 1 may be applied to the gesture mapping unit according to the example illustrated in FIG. 4A.

According to one example, in response to one touch gesture being detected during a predetermined time, the hearing device 410 may enter the movement control mode. Accordingly, the hearing device 410 may detect audio signals received from at least two microphones and may estimate the head movement, thereby controlling the operation of the hearing device 410.

In response to the touch gestures being detected twice during the predetermined time, the hearing device 410 may enter the general mode. Upon entering the general mode, the hearing device 410 may not detect the audio signals from the outside nor estimate the head movement, and therefore the operation of the hearing device 410 may not be controlled based on the head movement.

Referring to FIG. 4B, an example of a hearing device 420 that includes a telecoil is provided. The telecoil may detect the magnetic field around the hearing device 420. The hearing device 420 may detect a hand gesture of the user using a change in the magnetic field.

When the user wearing a magnetic ring waves his or her hand vertically or horizontally, the magnetic field around the hearing device 420 may be changed. The hearing device 420 may detect the hand gesture using the telecoil.

For example, a hand gesture of waving a hand vertically for a predetermined time may correspond to the operation of entering the movement control mode. A hand gesture of waving a hand horizontally for a predetermined time may correspond to the operation of entering the general mode. The foregoing information may be stored in a gesture mapping unit.

In response to detecting a hand gesture of waving the hand vertically for the predetermined time, the hearing device 420 may enter the movement control mode, thereby estimating the head movement of the user using the calculated information on the audio signals and controlling the operation of the hearing device 420.

In response to detecting a hand gesture of waving the hand horizontally for the predetermined time, the hearing device 420 may enter the general mode. When the hearing device 420 is in the general mode, although the information on the audio signals is calculated, the head movement may not be estimated.

Referring to (a) of FIG. 4C, the user is looking straight ahead while wearing a hearing device 430. In this instance, a movement 1 indicating a repetitive movement of turning the head from the front to the left by about 45° or more twice or thrice within three seconds may correspond to the operation of entering the movement control mode. Such information may be stored in a head movement mapping unit.

In response to the head being repeatedly turned from the front to the left by about 45° or more thrice within three seconds, as illustrated by a movement from (a) to (b), the hearing device 430 may identify the operation of entering the movement control mode corresponding to the movement 1, thereby setting the hearing device 430 to the movement control mode. In the movement control mode, the hearing device 430 may control the operation using the estimated head movement.

Figure 5:
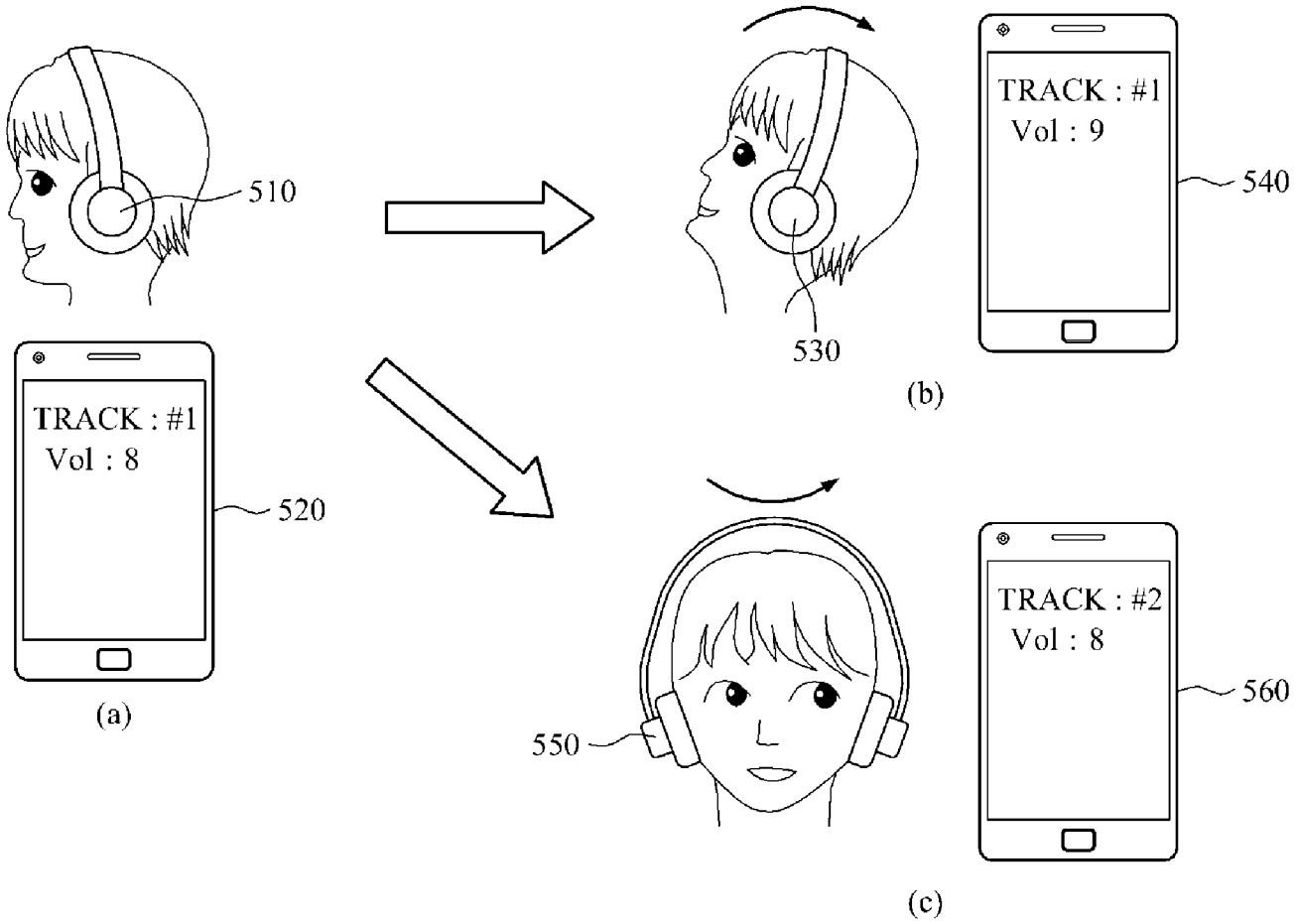
FIG. 5 is a diagram illustrating an example of a method of controlling operation of a hearing device.

FIG. 5 illustrates another example of operation control of a hearing device 510.

Referring to FIG. 5(*a*), the user is wearing the hearing device 510 and looking straight ahead. In this example, the hearing device 510 is set to the movement control mode and is connected with an external device 520 such as a mobile terminal or an mp3 player. The external device 520 may display information on music the user is listening to.

The hearing device 510 may estimate a head movement using audio signals generated the outside, such as an ambient sound of talking or ambient noise. In addition, the hearing device 510 may include information on operations of the external device 520, the operations mapped with predetermined head movements. For example, a head movement of lifting a head up may correspond to an operation of increasing volume of the external device 520 while a movement of lowering the head may correspond to an operation of decreasing the volume of the external device 520, as illustrated in FIG. 5(*b*). A head movement of turning the head from the front to the left may correspond to an operation of increasing an index, for example a track number, of music being reproduced by the external device 520 while a head movement of turning the head from the front to the right may correspond to an operation of reducing the index of the music being reproduced by the external device 520, as illustrated in FIG. 5(*c*).

In one example, when the user lifts his or her head as shown by a movement from FIG. 5(*a*) to FIG. 5(*b*), the hearing device 530 may estimate a head movement of lifting the head using ambient audio signals. According to the estimated head movement, the hearing device 530 may transmit a control signal for increasing volume of an external device 540 to the external device 540. The external device 540 that received the control signal may increase the volume, for example, from 8 to 9.

In another example, when the user turns his or her head from the front to the left as illustrated by a movement from FIG. 5(*a*) to FIG. 5(*c*), a hearing device 550 may estimate a head movement of turning the head from the front to the left using at least one of ITD information and ILD information of detected audio signals. According to the estimated head movement, the hearing device 530 may transmit a control signal for increasing an index of music being reproduced by an external device 560 to the external device 560. The external device 560 having received the control signal may increase the index of the music, for example from 1 to 2.

Figure 6:
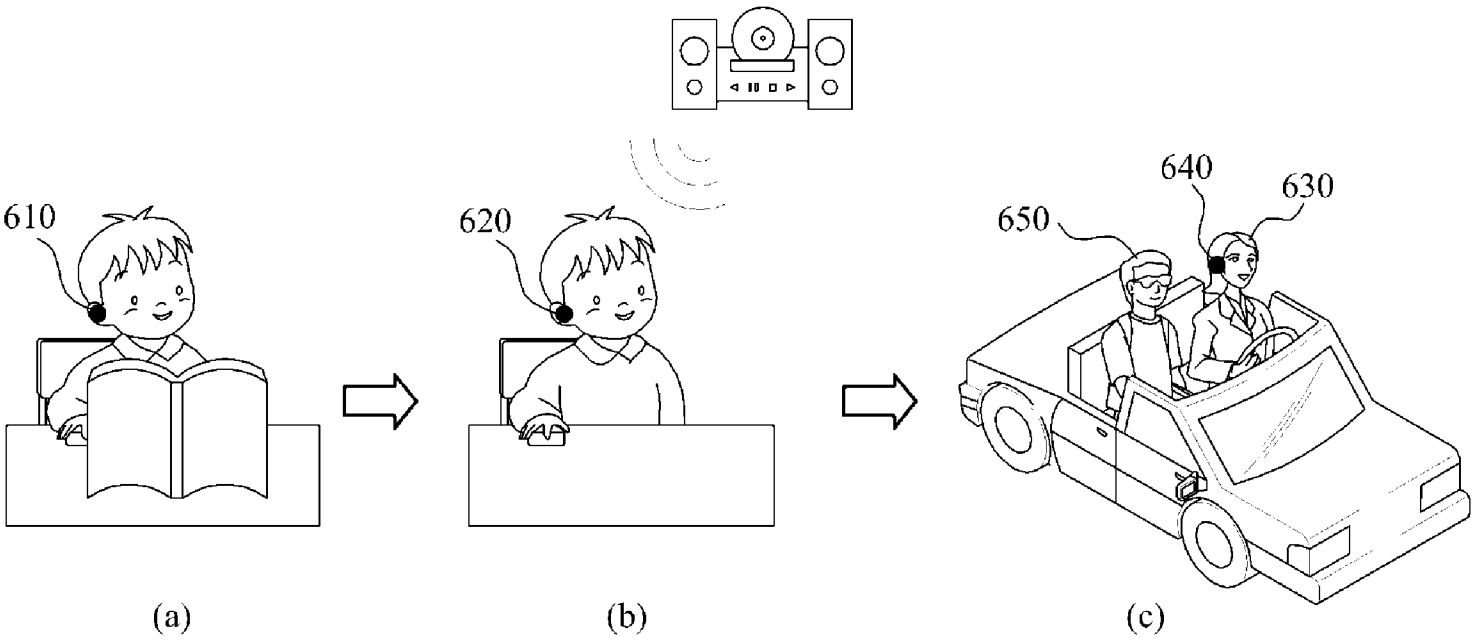
FIG. 6 is a diagram illustrating another example of a method of controlling operation of a hearing device.

FIG. 6 illustrates another example of operation control of a hearing device 610.

Referring to FIG. 6, the hearing device 610 detects an external environment and recommends another operation mode more proper for the external environment than a current operation mode.

In FIG. 6(*a*), the user is reading a book wearing the hearing device 610. Because the user is in a quiet environment, the user may set the operation mode of the hearing device 610 to a quiet mode. In the quiet mode, the hearing device 610 may turn on a noise removal algorithm, thereby providing a noiseless state to the user.

When the external environment is changed, a hearing device 620 may detect the change in the external environment using an oscillation frequency, a frequency, a radio wave, or the like of audio signals generated at an external source. The user may move from a quiet environment illustrated in FIG. 6(*a*) to an environment in which music sound is playing, as illustrated in FIG. 6(*b*). In response, the hearing device 620 may detect that the user is in an environment in which music is playing, using an oscillation frequency, a frequency, a radio wave, or the like of audio signals generated from a speaker. Therefore, the hearing device 620 may identify the music mode as the more proper operation mode than the quiet mode that is the current operation mode. The hearing device 620 may recommend a switch to the music mode by providing information on the music mode to the user. For example, the hearing device 620 may provide a voice message "Would you like to change to the music mode?" to the user. When the user nods within five seconds after the voice message was provided, the hearing device 620 may estimate the head movement of the user using the audio signals detected from the outside. The audio signals detected from the outside may include either or both of audio signals related to the music generated from the speaker and audio signals generated from another source, as picked up by microphones installed within the hearing device 620. The hearing device 620 may change or maintain the operation mode based on the estimated head movement. For example, when the head movement of nodding within five seconds is set corresponding to 'YES', the hearing device 620 may provide a voice message "It will be changed to the music mode" as feedback information to the user and change the quiet mode to the music mode. Accordingly, the hearing device 620 may turn of a feedback removal algorithm and the noise removal algorithm so that the user may focus on the music while maximizing a sampling rate to provide the music of a high sound quality.

In addition, a user 630 may talk to a fellow passenger 650 during driving as shown in FIG. 6(*c*). The user 630 may be wearing a hearing device 640. The hearing device 640 may detect that the user is in an environment of talking inside a car, using an oscillation frequency, a frequency, a radio wave, or the like of audio signals generated from inside and outside of the car and from talk with the fellow passenger 650. The hearing device 640 may identify a driver conversation mode as a more proper mode than the music mode that is the current operation mode. The hearing device 640 may recommend a switch to the driver conversation mode and provide information on the driver conversation mode to the user. For example, the hearing device 640 may provide the user with a voice message "It is recommended to change to the driver conversation mode. Would you like to change to the driver conversation mode?" If the user shakes his or her head right and left within five seconds after the voice message was provided to the user, the hearing device 640 may estimate the head movement of the user using the audio signals detected from the outside. The hearing device 640 may change or maintain the operation mode based on the estimated head movement. For example, when the head movement of horizontal shaking within five seconds is set corresponding to 'NO', the hearing device 640 may provide a voice message "It will not be changed to the driver conversation mode but maintain the music mode." as feedback information to the user, and maintain the music mode. Accordingly, the hearing device 640 is configured to initiate the switch between different modes by recommending a proper mode to the user by monitoring the change in its environment.

Figure 7:
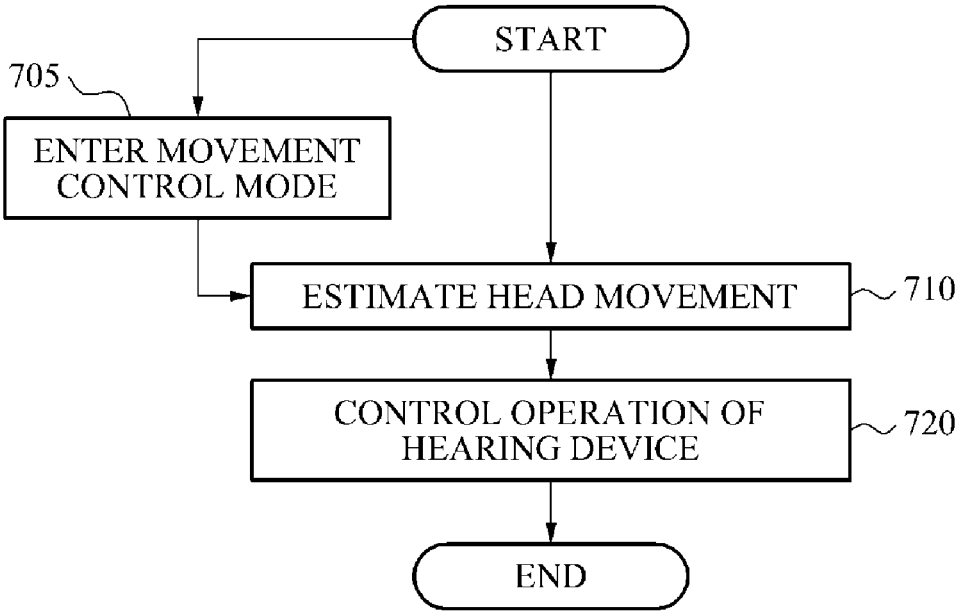
FIG. 7 is an operational flowchart illustrating an example of a control method for a hearing device.

FIG. 7 illustrates an example of a control method for a hearing device.

Referring to FIG. 7, the control method involves entering a movement control mode in 705. As aforementioned, the movement control mode refers to an operation mode for controlling the operation of the hearing device by estimating a head movement of a user whereas a general mode refers to an operation mode for performing a general operation of the hearing device. The movement control mode may be accessed basically from the hearing device or through a UI. The UI may include a user gesture and the head movement. In 705, the movement control mode is accessed by the UI.

In 705, the hearing device may enter the movement control mode by detecting the user gesture or the head movement. In one example, the user gesture may include a touch gesture and a hand gesture.

In one example, the hearing device may enter the movement control mode by detecting the touch gesture of the user using a touch sensor. For example, a one-time touch gesture during a predetermined time may correspond to an operation of entering the movement control mode.

In another example, the hearing device may enter the movement control mode by detecting the hand gesture of the user using a telecoil. For example, a gesture of turning a hand clockwise within a predetermined time may correspond to an operation of entering the movement control mode.

In still another example, the hearing device may enter the movement control mode using the head movement. For example, a movement of shaking a head right and left three times within a predetermined time may correspond to an operation of entering the movement control mode.

The control method for the hearing device may estimate the head movement in 710. In 710, the hearing device may estimate the head movement using audio signals detected from the outside. The hearing device may detect the audio signals received from at least two microphones. In one example, the hearing device may calculate time difference information and level difference information of the audio signals detected using relative positions of the at least two microphones. The hearing device may estimate the head movement based on at least one of the time difference information and the level difference information. In an example in which the hearing device is a binaural device, the hearing device may estimate the head movement based on at least one of ITD information and ILD information of the audio signals.

The hearing device may estimate the head movement corresponding to at least one of the time difference information and the level difference information by referencing a lookup table. The lookup table may include information on at least one of predetermined time difference information and predetermined level difference information, and corresponding head movements.

The control method for the hearing device may control at least one of operation of the hearing device and operation of an external device based on the estimated head movement, in 720. In response to predetermined head movements being detected, the hearing device may control at least one of the operation of the hearing device and the operation of the external device corresponding to the detected predetermined head movements. Information on the operation of the hearing device and information on the operation of the external device mapped with the predetermined head movements may be stored in advance in the hearing device. In response to any one of the predetermined head movements corresponding to the estimated head movement, the hearing device may control at least one of the operation of the hearing device and the operation of the external device, the at least one operation corresponding to the estimated head movement, using at least one of the information on the operation of the hearing device and the information on the operation of the external device. The operation is mapped with the any one of the predetermined head movements.

In 720, the hearing device may additionally detect the user's gesture. For example, the hearing device may detect the touch gesture using the touch sensor and the hand gesture using the telecoil. When a predetermined user gesture is detected, the hearing device may control at least one of the operation of the hearing device and the operation of the external device, based on the predetermined user gesture detected by the hearing device. The information regarding the operation of the hearing device and the operation of the external device may be mapped with the predetermined user gesture and stored in advance in the hearing device. The hearing device may control the operation of the hearing device based on the detected user gesture using the information mapped with the predetermined user gesture. For example, in response to the user lifting his or her head, the hearing device may perform an operation of increasing volume, which is mapped with the movement of lifting the head. When the user performs a touch gesture, the hearing device may detect the touch gesture. The hearing device may identify a cancel operation mapped with the touch gesture, and therefore cancel the operation of increasing the volume.

In addition, in 720, the hearing device may provide the information on the operation of the hearing device to the user. For example, the hearing device may provide feedback information, hearing device status information, and/or information on an operation other than a current operation of the hearing device. The feedback information may include any one of a visual feedback, an audio feedback, and a tactile feedback.

Since the description about FIGS. 1 to 6 may be directly applied to the control method of the hearing device shown in FIG. 7, a detailed description about the control method will not be omitted for conciseness.

The above-described examples of methods of controlling an apparatus may be recorded, stored, or fixed in one or more non-transitory computer-readable media that includes program instructions to be implemented by a computer to cause a processor to execute or perform the program instructions. The media may also include, alone or in combination with the program instructions, data files, data structures, and the like. The program instructions recorded on the media may be those specially designed and constructed, or they may be of the kind well-known and available to those having skill in the computer software arts. Examples of non-transitory computer-readable media include magnetic media such as hard disks, floppy disks, and magnetic tape; optical media such as CD ROM disks and DVDs; magneto-optical media such as optical discs; and hardware devices that are specially configured to store and perform program instructions, such as read-only memory (ROM), random access memory (RAM), flash memory, and the like. Examples of program instructions include both machine code, such as produced by a compiler, and files containing higher level code that may be executed by the computer using an interpreter. The described hardware devices may be configured to act as one or more software modules in order to perform the operations and methods described above, or vice versa.

Various units described above may be implemented using hardware components and software components. For example, microphones, amplifiers, band-pass filters, audio to digital convertors, and processing devices may be included in the units. A processing device may be implemented using one or more general-purpose or special purpose computers, such as, for example, a processor, a controller and an arithmetic logic unit, a digital signal processor, a microcomputer, a field programmable array, a programmable logic unit, a microprocessor or any other device capable of responding to and executing instructions in a defined manner. The processing device also may access, store, manipulate, process, and create data in response to execution of the software. For purpose of simplicity, the description of a processing device to is used as singular; however, one skilled in the art will appreciated that a processing device may include multiple processing elements and multiple types of processing elements.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A hearing device comprising:

a movement estimation unit configured to estimate a head movement using audio signals; and a hearing device control unit configured to control an operation of the hearing device based on the estimated head movement by comparing the estimated head movement to predetermined head movements, and in response to determining that the estimated head movement matches one of the predetermined head movements, configured to control the operation of the hearing device corresponding to the one of the predetermined head movements.

2. The hearing device of claim 1, further comprising:

an audio signal detection unit comprising at least two microphones and configured to detect the audio signals through the at least two microphones.

3. The hearing device of claim 2, wherein the movement estimation unit is configured to estimate the head movement based on time difference information or level difference information related to the detected audio signals.

4. The hearing device of claim 3, wherein the movement estimation unit is configured to acquire at least one of the time difference information and the level difference information based on relative positions of the microphones.

5. The hearing device of claim 3, wherein the time difference information comprises interaural time difference (ITD) information of the detected audio signals, and the level difference information comprises interaural level difference (ILD) information of the detected audio signals.

6. The hearing device of claim 3, further comprising:

a lookup table relating at least one of predetermined time difference information and predetermined level difference information with a corresponding head movement, wherein the movement estimation unit is configured to estimate the head movement corresponding to the at least one of the time difference information and the level difference information of the detected audio signals by referencing the lookup table.

7. The hearing device of claim 1, further comprising:

a gesture detection unit configured to detect a user gesture, wherein the hearing device control unit is configured to control the operation of the hearing device based on a predetermined user gesture in response to the predetermined user gesture being detected by the gesture detection unit.

8. The hearing device of claim 7, further comprising:

a gesture mapping unit configured to store mapping information on the operation of the hearing device to the predetermined user gesture, wherein the hearing device control unit is configured to control the operation of the hearing device based on the detected user gesture by referencing the gesture mapping unit.

9. The hearing device of claim 1, wherein the hearing device control unit is configured to control the operation of the hearing device based on a predetermined head movement in response to the predetermined head movement being detected.

10. The hearing device of claim 9, further comprising:

a head movement mapping unit configured to store mapping information on the operation of the hearing device to the predetermined head movement, wherein the hearing device control unit is configured to control the operation of the hearing device based on the estimated head movement by referencing the head movement mapping unit.

11. The hearing device of claim 1, further comprising:

an operation information providing unit configured to provide information on the operation of the hearing device to the user, wherein the operation information providing unit is configured to provide feedback information comprising at least one of a visual feedback, an audio feedback, and a tactile feedback related to the operation of the hearing device.

12. The hearing device of claim 11, wherein the operation information providing unit is configured to provide information on an operation other than a current operation of the hearing device.

13. The hearing device of claim 1, further comprising:

an external device control unit configured to control an operation of an external device based on the estimated head movement.

14. A hearing device controller comprising:

a movement estimation unit configured to estimate a head movement using audio signals received from a hearing device; and a hearing device control unit configured to control an operation of the hearing device based on the estimated head movement by comparing the estimated head movement to predetermined head movements, and in response to determining that the estimated head movement matches one of the predetermined head movements, configured to control the operation of the hearing device corresponding to the one of the predetermined head movements.

15. The hearing device controller of claim 14, further comprising:

a communication unit configured to receive information on the audio signals from the hearing device.

16. The hearing device controller of claim 14, further comprising:

an external device control unit configured to control an operation of an external device based on the estimated head movement.

17. The hearing device controller of claim 14, further comprising:

an operation information providing unit configured to provide information on the operation of the hearing device to the user, wherein the operation information providing unit is configured to provide feedback information comprising at least one of a visual feedback, an audio feedback, and a tactile feedback related to the operation of the hearing device.

18. A hearing device comprising:

an audio signal detection unit comprising at least two microphones and configured to detect audio signals through the at least two microphones; and a communication unit configured to transmit information on the audio signals to a hearing device controller, wherein information from the audio signals is used to estimate a head movement, the estimated head movement is compared to predetermined head movements, and in response to determining that the estimated head movement matches one of the predetermined head movements, an operation of the hearing device corresponding to the one of the predetermined head movements is controlled.

19. A method of operating a hearing device, comprising:

detecting audio signals through at least two microphones of the hearing device;

analyzing the audio signals to detect a head movement of a user; and controlling an operation of the hearing device based on the detected head movement by comparing the detected head movement to predetermined head movements, and in response to determining that the detected head movement matches one of the predetermined head movements, controlling the operation of the hearing device corresponding to the one of the predetermined head movements.

20. The method of claim 19, wherein the analyzing of the audio signals comprises estimating the head movement of the user based on time difference information or level difference information based on relative positions of the at least two microphones.

* * * * *